US007299578B2

(12) United States Patent
Molinaro

(10) Patent No.: US 7,299,578 B2
(45) Date of Patent: Nov. 27, 2007

(54) STORE SECURITY DEVICE WITH ADVERTISING COVER

(76) Inventor: Joseph J Molinaro, 8101 N. Toltec Dr., North Little Rock, AR (US) 72116

( * ) Notice: Subject to any disclaimer, the term of this patent is extended or adjusted under 35 U.S.C. 154(b) by 369 days.

(21) Appl. No.: 10/872,178

(22) Filed: Jun. 18, 2004

(65) Prior Publication Data

US 2005/0279000 A1 Dec. 22, 2005

(51) Int. Cl.
*G09F 15/00* (2006.01)

(52) U.S. Cl. ..... 40/606.01; 40/606.18

(58) Field of Classification Search ..... None
See application file for complete search history.

(56) References Cited

U.S. PATENT DOCUMENTS

| | | | | |
|---|---|---|---|---|
| 4,115,937 | A | 9/1978 | Wolpert | |
| 4,144,664 | A | 3/1979 | De Korte | |
| 4,817,319 | A | 4/1989 | Vitale | |
| 4,944,971 | A | 7/1990 | McLaughlin | |
| D330,919 | S | 11/1992 | Von Canal | |
| D334,775 | S | 4/1993 | Foster | |
| 5,316,404 | A * | 5/1994 | Hensel | 402/79 |
| D378,301 | S | 3/1997 | Leksell | |
| 5,787,621 | A | 8/1998 | Leksell | |
| 5,860,237 | A | 1/1999 | Johnson | |
| 5,942,978 | A * | 8/1999 | Shafer | 340/572.9 |
| 5,966,857 | A | 10/1999 | Pettersson et al. | |
| 5,979,113 | A | 11/1999 | Hering | |
| D425,938 | S | 5/2000 | Skog | |
| 6,212,809 | B1 | 4/2001 | Gaule | |
| 6,237,267 | B1 * | 5/2001 | Lackomar | 40/593 |
| 6,457,334 | B1 * | 10/2002 | Harker et al. | 68/3 R |
| 6,752,837 | B2 * | 6/2004 | Karp | 340/572.1 |
| 6,971,198 | B2 * | 12/2005 | Venegas, Jr. | 40/607.01 |
| 2005/0166431 | A1 * | 8/2005 | Boron et al. | 40/607.03 |

OTHER PUBLICATIONS

Pages 1-3 from web archive for Faber Pro-Motion dated May 31, 2003 showing Ampro Security antenna cover.*

* cited by examiner

*Primary Examiner*—Joanne Silbermann
(74) *Attorney, Agent, or Firm*—David A. Belasco; Belasco Jacobs & Townsley, LLP

(57) ABSTRACT

A store security device with advertising cover includes a store security system for detecting magnetic tags attached to merchandise. The security device includes a magnetic sensor mounted in a frame attached to a base. A cover having first and second side panels joined together at their side and/or top edges is sized and shaped to fit slidably over the frame. The cover includes an aperture for the sensor or is fabricated from material that does not interfere with its operation. Advertising or promotional material is affixed to at least one of the first and second side panels. The side panels may include one or more pockets for dispensing promotional materials. The side panels may include one or more receptacles having a transparent outer wall. These receptacles are sized and shaped to hold removable printed advertising or promotional sheets. The receptacles have an open top or side and a closed bottom.

2 Claims, 4 Drawing Sheets

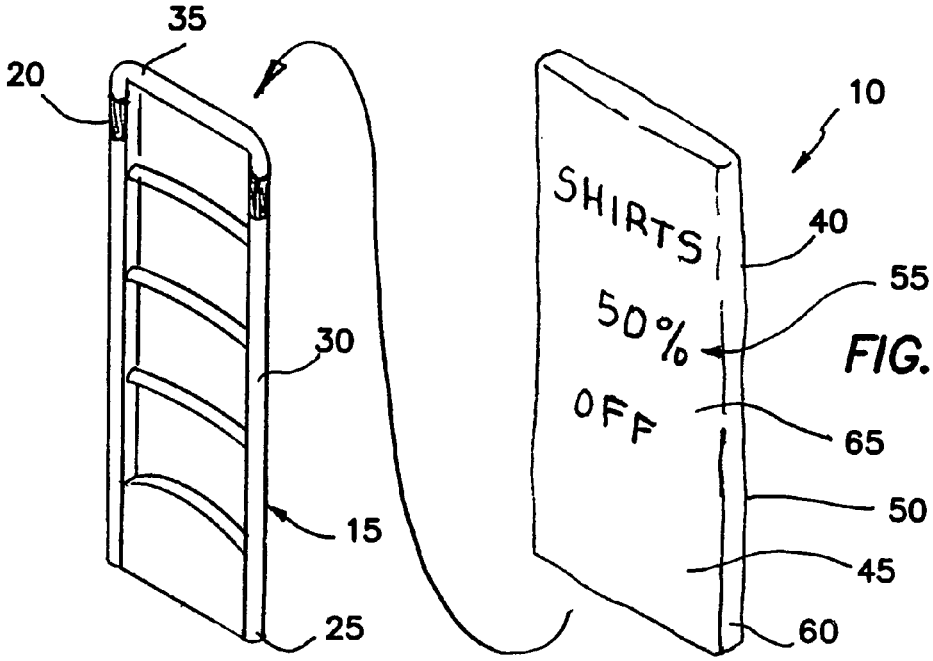
FIG. 1
FIG. 2
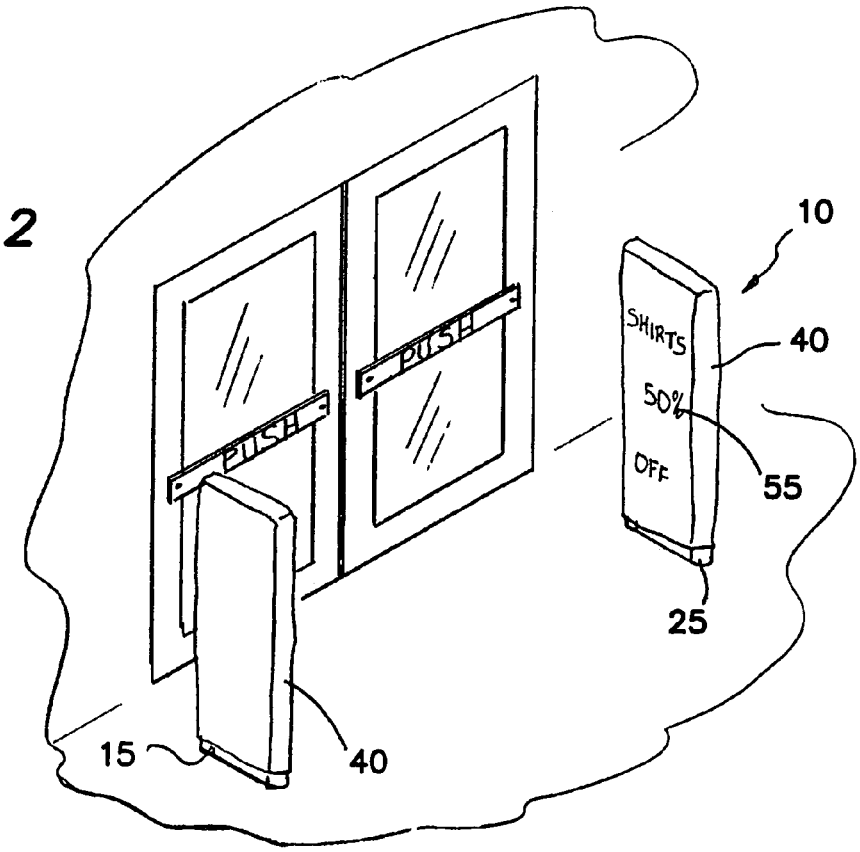

STORE SECURITY DEVICE WITH ADVERTISING COVER

FIELD OF INVENTION

The invention pertains to in-store advertising. More particularly, the invention relates to the use of store security devices in combination with fitted covers that include promotional material, advertising and visual displays.

BACKGROUND OF THE INVENTION

Store security systems are used in conjunction with magnetic tagging devices affixed to merchandise. The tagging devices are removed or deactivated at the checkout counter at the time of purchase. The security system is typically positioned at a store exit and will detect the passage of any tagging device that has not bee deactivated or removed. The security system may emit an alerting sound or provide remote notification to security personnel. The detecting portion of the security system is typically housed in a vertically oriented framework near the store exit and can have an off putting effect on customers. The presence of the devices says, in effect, "this store assumes its customers may attempt to steal merchandise." Being relatively large (approximately 4 feet high and 2 feet wide), the security devices are easily noticed. For this reason, the instant invention contemplates using this easily noticed store fixture to provide a medium for promotional messages and advertising. In most store locations the security devices are noticeable upon entrance into the store as well as upon exit. Thus any advertisement for goods sold within the store would be visible to the customer just as he enters the store.

Various frames and fixtures have been developed to hold advertising displays, however, none have been designed to work in conjunction with store security devices or systems. U.S. Pat. No. 5,966,857, issued to Pettersson et al., discloses an advertising display. The disclosed device is an advertising display that is easily erected and may be used as a free-standing display or as a hanging display. The device is not specifically designed for use with store security devices. The display includes sub-assemblies can slip over one another to be easily replaced with new sub-assemblies containing different advertising.

U.S. Pat. No. 5,787,621, issued to Leskell, is directed to a display stand. This stand is described as being used with bases and, alternatively, without the provided bases. The display units or sub-assemblies described mount around and atop the base and then rest either on the base or upon each other. The display units are stacked on support columns. The lower edges of an upper section of the support connectors come to rest on an upper end of a display stand. The display portion extends below the upper section of the support connectors such that the display portion of the header surrounds the upper end of the display stand. A lower section of the support connectors is sized similar to the connector cards and is similarly received between flaps and free edges of the top of the upper support column.

U.S. Pat. No. 5,860,237, issued to Johnson, discloses a sleeve sign and stand. The sign stand includes a frame and a base. The frame comprises a top, a first vertical column, and a second vertical column. A first or outer vertical edge section of a vertical column and a second outer vertical edge surface of a second vertical column supports a sleeve when the sleeve is stretched over the frame. The outer surface of the column comprises a plurality of raised portions and recessed portions. Recessed portions serve to receive and support the sleeve in the installed condition. The raised portions serve to retain the sleeve on vertical surface by requiring the sleeve to stretch further in order to move up or down on the vertical surface. The raised portions form a smooth wave. The vertical surface comprises similar raised portions and recessed portions. The plurality of raised portions and recessed portions of sign stand allows different numbers and heights of sleeves to be used with the same sign stand.

U.S. Pat. No. 4,944,971, issued to McLaughlin, is directed to automobile "sun visor slip covers". The slip cover has a shape that generally matches that of the sun visor, and thus is elongate and includes two longitudinal side edges and two end edges, all bordering the central body having a first surface and a second surface. The sun visor will have a prescribed width and length, and thus, the cover has a length as measured between the two end edges and a prescribed width as measured between the two side edges. The slipcover is monolithic and is formed of a material that is stretchable, such as a rubberized or plastic type material. The cover includes an opening that extends from the side edge to a location that is spaced from a side edge. The opening has an undeformed axial extent that is shorter than the width of the sun visor; however, the stretchable nature of the cover permits the opening to be sufficiently enlarged to permit the sun visor to be inserted into the cover via the opening. The slipcover also includes an area on the outer surface thereof on which suitable indicia, such as advertising logos or the like, can be placed.

U.S. Patent Application No. US 2002/0108279, by Hubbard, II et al., is directed to an advertising cover for insulated beverage box. The box cover has a plurality of clear windows that allow advertising graphics to show through so that when a person is waiting to be served by a server, he or she can view the advertising. The advertising graphics are removable and replaceable so that they can be customized to a particular sporting or entertainment event. The box cover simply slips over the ice chest body and cover.

It is an objective of the present invention to provide a means cover store security devices and provide a more customer-friendly environment. It is a further objective to provide a location for the display of advertising and promotional materials at the entrance of a store. It is a still further objective of the invention to provide such advertising locations without interfering with the operation of the security devices. Finally, it is an objective to provide easily interchangeable covers for security devices that can be manufactured and installed inexpensively.

While some of the objectives of the present invention are disclosed in the prior art, none of the inventions found include all of the requirements identified.

SUMMARY OF THE INVENTION

The present invention addresses all of the deficiencies of prior art display devices and satisfies all of the objectives described above.

(1) A store security device with advertising cover can be constructed from the following components. A store security device is provided. The device has a sensor, a base, a frame portion extending vertically from the base, and an upper surface. A cover is provided. The cover has a first side panel and a second side panel. The cover is sized and shaped to fit slidably over the frame portion. Advertising material is provided. The advertising material is located on at least one of the first and second side panels.

(2) In a variant of the invention, the side panels are joined at their side edges to form a sleeve.

(3) In a further variant, the first and second side panels are joined at their top edges to form a closed top. The top has an upper surface and a lower surface.

(4) In still a further variant, the lower surface of the top is located on the upper surface of the store security device.

(5) In yet another variant, the first and second side panels are sized such that the cover is suspended above the base.

(6) In yet a further variant of the invention, the advertising cover includes an aperture. The aperture penetrates at least one of the first and second side panels and is sized, shaped, and located to align with the sensor.

(7) In another variant, the advertising cover includes at least one pocket. The pocket is located on at least one of the first and second side panels and is sized and shaped to contain either promotional items or materials.

(8) In still another variant, the advertising cover includes at least one receptacle. The receptacle has a transparent outer wall, either an open top or open side and a closed bottom. Removable advertising media is provided. The media is sized and shaped to fit slidably within the receptacle.

(9) In yet another variant, the cover is fabricated from material selected from the group consisting of paper, paperboard, plastic and wood.

(10) In a final variant, the first and second side panels are joined at their edges using a method selected from the group consisting of sewing, gluing, stapling and buttoning.

An appreciation of the other aims and objectives of the present invention and an understanding of it may be achieved by referring to the accompanying drawings and the detailed description of a preferred embodiment.

DESCRIPTION OF THE DRAWINGS

FIG. 1 is a perspective view of the preferred embodiment of the invention including a store security device with removable advertising cover;

FIG. 2 is a perspective view of two of the FIG. 1 embodiment disposed in front of a store exit;

DETAILED DESCRIPTION OF THE PREFERRED EMBODIMENT (1) FIGS. 1-10 illustrate a store security device with advertising cover 10 that can be constructed from the following components. A store security device 15 is provided. The device 15 has a sensor 20, a base 25, a frame portion 30 extending vertically from the base 25, and an upper surface 35. A cover 40 is provided. The cover 40 has a first side panel 45 and a second side panel 50. The cover 40 is sized and shaped to fit slidably over the frame portion 30. Advertising material 55 is provided. The advertising material 55 is located on at least one of the first 45 and second 50 side panels.

Figure 3:
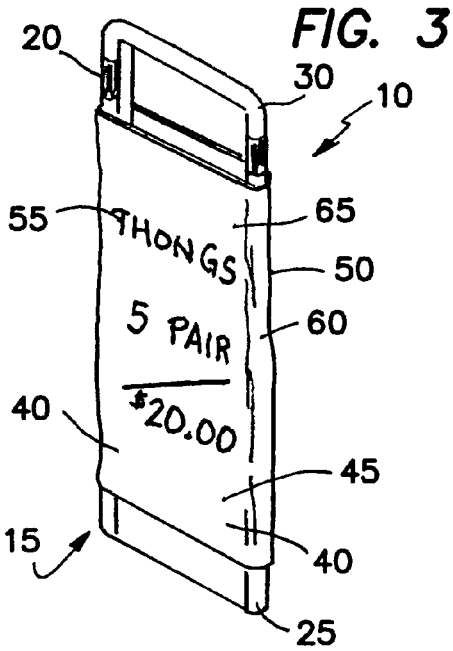
FIG. 3 is a perspective view of a second embodiment of the invention in which the side panels are joined at their side edges.

(2) In a variant of the invention, as illustrated in FIGS. 1 and 3, the side panels 45, 50 are joined at their side edges 60 to form a sleeve 65.

Figure 4:
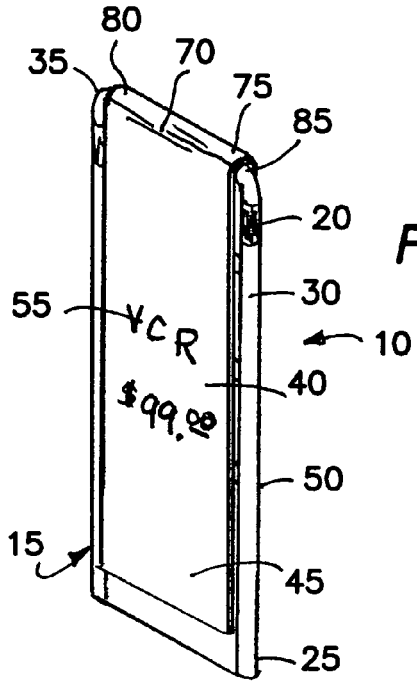
FIG. 4 is a perspective view of a third embodiment of the invention in which the side panels are joined at their top edges.

(3) In a further variant, as illustrated in FIG. 4, the first 45 and second 50 side panels are joined at their top edges 70 to form a closed top 75. The top 75 has an upper surface 80 and a lower surface 85.

(4) In still a further variant, the lower surface 85 of the top 75 is located on the upper surface 35 of the store security device 15.

Figure 5:
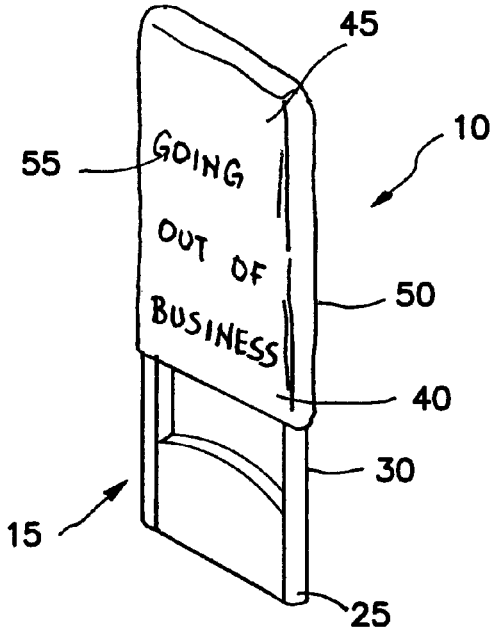
FIG. 5 is a perspective view of the FIG. 1 embodiment of the invention in which the side panels are suspended above the security device base.

(5) In yet another variant, as illustrated in FIG. 5, the first 45 and second 50 side panels are sized such that the cover 40 is suspended above the base 25.

Figure 6:
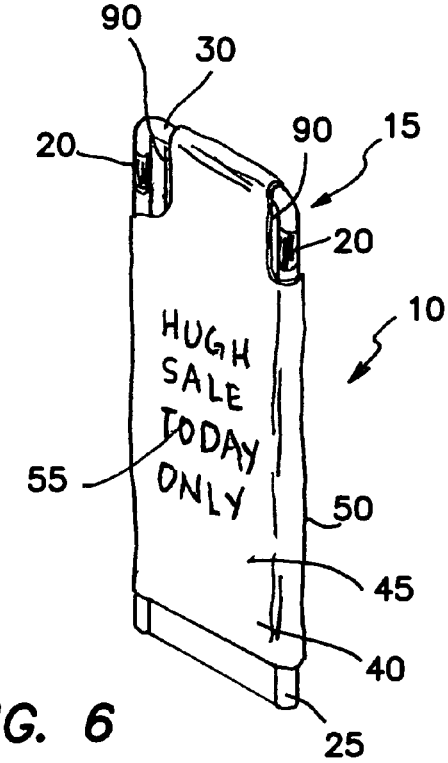
FIG. 6 is a perspective view of a fourth embodiment of the invention in which the side panels are joined at their top edges and side edges with apertures provided for the sensors.
Figure 10:
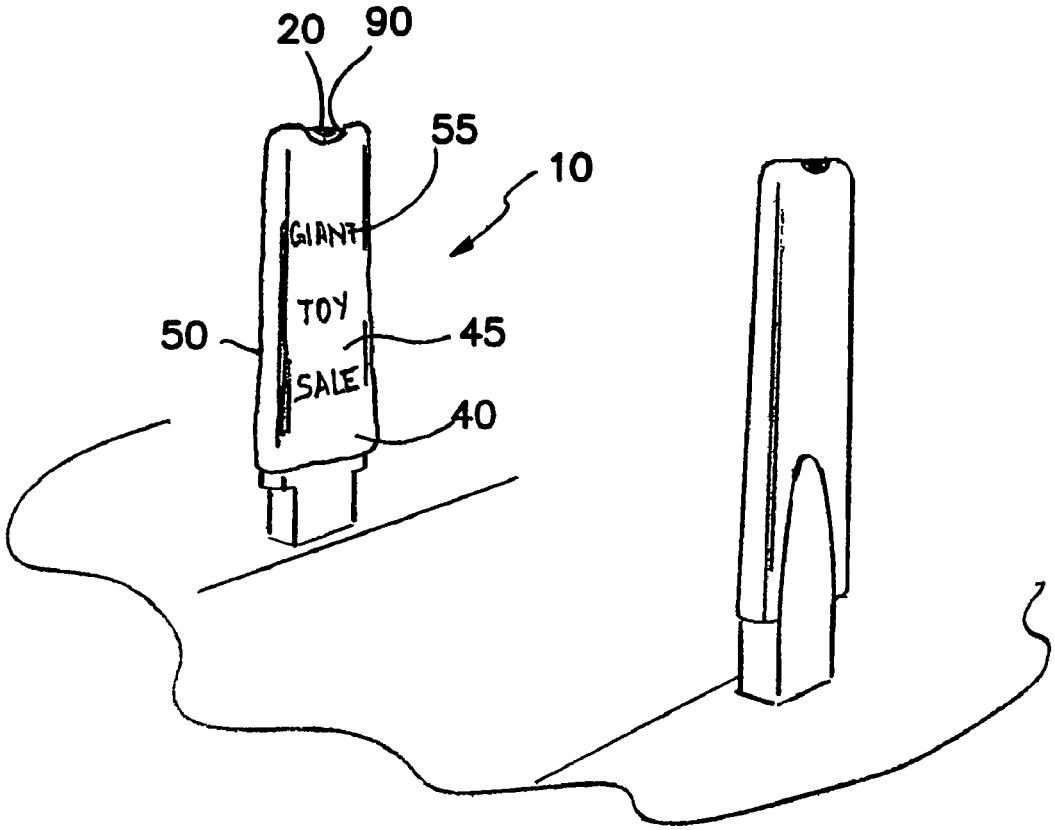
FIG. 10 is a perspective view of a fourth embodiment of the invention in which the advertising cover includes an aperture at the top of the cover to accommodate a sensor located at the top of the security device.

(6) In yet a further variant of the invention, as illustrated in FIGS. 6 and 10, the advertising cover 40 includes an aperture 90. The aperture 90 penetrates at least one of the first 45 and second 50 side panels and is sized, shaped, and located to align with the sensor 20.

Figure 7:
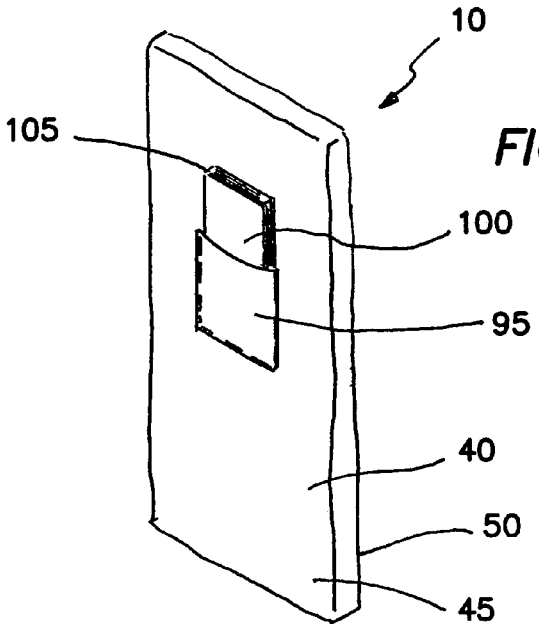
FIG. 7 is a perspective view of the FIG. 1 embodiment of the invention further including a pocket for promotional materials.

(7) In another variant, as illustrated in FIG. 7, the advertising cover 40 includes at least one pocket 95. The pocket 95 is located on at least one of the first 45 and second 50 side panels and is sized and shaped to contain either promotional items 100 or materials 105.

Figure 8:
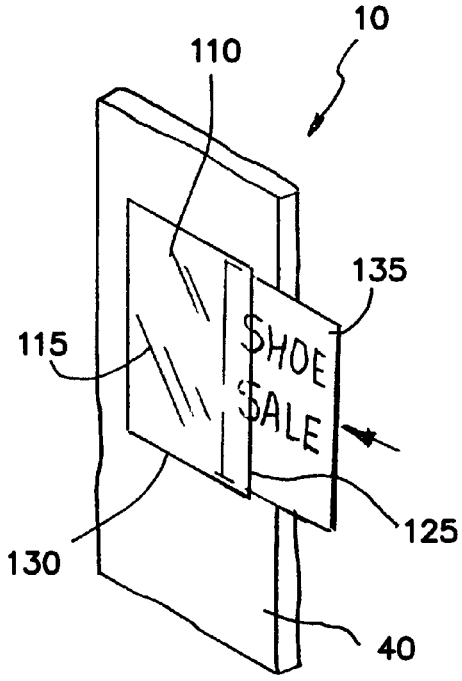
FIG. 8 is a perspective view of the FIG. 1 embodiment of the invention further including a receptacle for removable promotional or advertising materials with a side opening.
Figure 9:
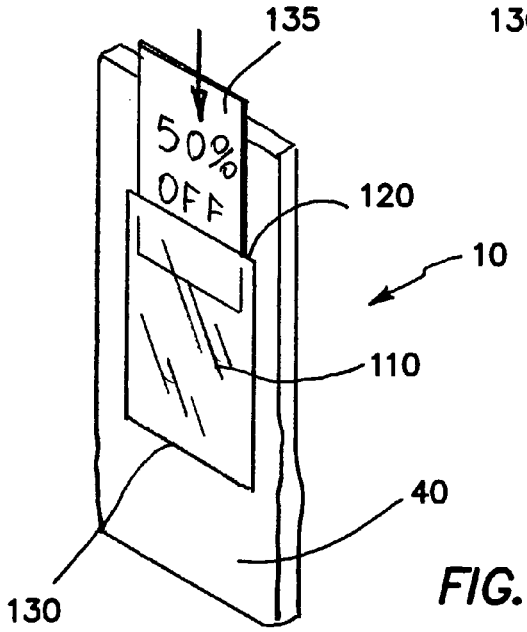
FIG. 9 is a perspective view of the FIG. 1 embodiment of the invention further including a receptacle for removable promotional or advertising materials with a top opening.

(8) In still another variant, as illustrated in FIGS. 8 and 9, the advertising cover 40 includes at least one receptacle 110. The receptacle 110 has a transparent outer wall 115, either an open top 120 or open side 125 and a closed bottom 130. Removable advertising media 135 is provided. The media 135 is sized and shaped to fit slidably within the receptacle 110.

(9) In yet another variant, the cover 40 is fabricated from material selected from the group consisting of paper, paperboard, plastic and wood.

(10) In a final variant, the first 45 and second 50 side panels are joined at their edges 60, 70 using a method selected from the group consisting of sewing, gluing, stapling and buttoning.

The store security device with advertising cover 10 has been described with reference to particular embodiments. Other modifications and enhancements can be made without departing from the spirit and scope of the claims that follow.

The invention claimed is:

1. A store security device with advertising cover, comprising:

a store security device, said device having a sensor, a base, a frame portion extending vertically from said base, and an upper surface;

a cover, said cover having a first side panel, a second side panel, and a top panel;

said cover being sized and shaped to fit slidably over said frame portion; and advertising material, said advertising material being disposed upon at least one of said first and second side panels, said cover further comprising two apertures, said apertures penetrating said first and second side panels and said top panel, wherein each aperture forms a contiguous loop that intersects the top panel and two side panels, said apertures being sized, shaped, and symmetrically disposed to expose two regions of said upper portion of said store security device frame portion.

2. A store security device with advertising cover, comprising:

a store security device, said device having a sensor, a base, a frame portion extending vertically from said base, and an upper surface;

a cover, said cover having a first side panel, a second side panel and a top panel;

said cover being sized and shaped to fit slidably over said frame portion; and advertising material, said advertising material being disposed upon at least one of said first and second side panels;

said cover further comprising a single aperture located about a central axis, said aperture contiguously penetrating said first and second side panels and said top panel and being sized, shaped, and symmetrically disposed to expose a central upper portion of said store security device frame portion.

* * * * *